US005087487A

United States Patent [19]

Katz et al.

[11] Patent Number: 5,087,487

[45] Date of Patent: Feb. 11, 1992

[54] NON-THERMOPLASTIC BINDER FOR USE IN PROCESSING TEXTILE ARTICLES

[75] Inventors: Howard G. Katz, Hightstown; Michael T. Sarkis, Lawrenceville, both of N.J.

[73] Assignee: National Starch and Chemical Investment Holding Corporation, Wilmington, Del.

[21] Appl. No.: 687,768

[22] Filed: Apr. 18, 1991

Related U.S. Application Data

[63] Continuation of Ser. No. 377,695, Jul. 10, 1989, abandoned.

[51] Int. Cl.[5] ..... B05D 3/02

[52] U.S. Cl. ..... 427/366; 427/389.9; 427/392; 526/304

[58] Field of Search ..... 427/366, 389.9, 392; 526/304

[56] References Cited

U.S. PATENT DOCUMENTS

| | | | |
|---|---|---|---|
| 3,301,809 | 1/1967 | Goldberg et al. | 260/29.6 |
| 3,708,388 | 1/1973 | Lindemann et al. | 161/247 |
| 3,714,099 | 1/1973 | Biale | 260/29.67 |
| 3,853,594 | 12/1974 | Moroff et al. | 427/366 X |
| 3,925,289 | 12/1975 | Sakato et al. | 260/29.6 B |
| 4,044,197 | 8/1977 | Wiest et al. | 526/304 |
| 4,075,387 | 2/1978 | Trapasso et al. | 428/288 |
| 4,094,849 | 6/1978 | Oyamada et al. | 260/29.6 MQ |
| 4,101,492 | 7/1978 | Lindemann et al. | 260/29.6 NR |
| 4,110,290 | 8/1978 | Mori et al. | 260/29.6 RW |
| 4,118,356 | 10/1978 | Devona et al. | 260/29.6 RB |
| 4,141,868 | 2/1979 | Emmons et al. | 260/23 AR |
| 4,151,147 | 4/1979 | Neuschwanter et al. | 260/29.6 T |
| 4,164,489 | 8/1979 | Daniels et al. | 260/29.6 R |
| 4,211,817 | 7/1980 | Buck et al. | 428/310 |
| 4,239,563 | 12/1980 | Iacoviello | 156/72 |
| 4,251,597 | 2/1981 | Emmons et al. | 428/500 |
| 4,278,727 | 7/1981 | Brabetz et al. | 428/290 |
| 4,324,832 | 4/1982 | Moroff et al. | 427/366 X |
| 4,332,600 | 6/1982 | Wegerhoff et al. | 65/2 |
| 4,418,031 | 11/1983 | Doerer et al. | 264/241 |
| 4,430,380 | 2/1984 | Honel et al. | 428/254 |
| 4,449,978 | 5/1984 | Iacoviello | 604/372 |
| 4,528,315 | 7/1985 | Eck et al. | 524/458 |
| 4,590,102 | 5/1986 | Rosamilia et al. | 427/374.1 |
| 4,605,589 | 8/1986 | Orphanides | 428/290 |
| 4,609,704 | 9/1986 | Hausman et al. | 524/710 |
| 4,612,224 | 9/1986 | Davis | 428/109 |
| 4,642,153 | 2/1987 | Lohr | 156/296 |
| 4,649,169 | 3/1987 | Thompson et al. | 524/247 |
| 4,673,702 | 6/1987 | Iacoviello | 524/459 |
| 4,698,384 | 10/1987 | Mao | 524/458 |
| 4,714,731 | 12/1987 | Iacoviello | 524/459 |
| 4,745,025 | 5/1988 | Mao | 428/288 |
| 4,797,964 | 7/1989 | Ritter et al. | 8/115.6 |

*Primary Examiner*—Michael Lusignan
*Attorney, Agent, or Firm*—Ellen T. Dec

[57] ABSTRACT

The present invention is directed to a process for treating textile substrates with a vinyl ester based emulsion polymer containing interpolymerized therein 0.5 to 5% of a polyethylenically unsaturated cross-linking comonomer and subsequently contacting the emulsion coated substrate with a heated metal surface.

9 Claims, No Drawings

NON-THERMOPLASTIC BINDER FOR USE IN PROCESSING TEXTILE ARTICLES

This application is a continuation of application Ser. No. 07/377,695, filed July 10, 1989, now abandoned.

BACKGROUND OF THE INVENTION

There are a wide range of textile applications, particularly in the production of non-wovens, wherein functional resins are applied to substrates in aqueous emulsion form and wherein the water is subsequently removed from the emulsion by contact of the treated substrate with a heated metal drum, roller or other moving metal surface. While this technique is generally satisfactory in the case of acrylate-based emulsions, most emulsions based on vinyl acetate homo- or copolymers suffer from the disadvantage of build-up of the emulsion; the emulsion plus fiber, and, in severe cases, sticking of the non-woven itself on the metal surface; thus resulting in substantial down-time, with consequent cost increase, in the production of the non-woven.

Previously attempts have been made to overcome these problems by the addition of release agents, waxes, certain surfactants, silicones, etc., as well as post-cross-linking monomers such as N-methylol acrylamide; however, these have not been fully effective and may interfere with the performance of the binding system, particularly when used at the very high levels needed for even partial effectiveness.

SUMMARY OF THE INVENTION

We have now found that the incorporation of a multi-functional monomer into the vinyl acetate based emulsion polymer permits drying of the emulsion on the hot metal surface without undesirable residue build-up.

The present invention is therefore directed to a process for treating textile substrates by impregnating the substrate with a vinyl ester based emulsion polymer containing interpolymerized therein 0.5 to 5% of a multifunctional cross-linking comonomer and subsequently contacting the substrate with a heated metal surface.

This technique is particularly useful in emulsion polymers containing post-curing functional groups such as N-methylol acrylamide. While these particular multi-functional monomers have previously been incorporated in emulsion polymers, they have generally been used in substantial lower amounts as chain extension materials to build molecular weights and thereby change the molecular morphology. While the literature has included general references to the use of a broader range of amounts of these monomers, the commercial use of these monomers has, in effect, been limited to amounts less than about 0.25%, and most usually less than 0.1%, since larger amounts of monomers are believed to have a deleterious effect on film formulation, and binding capability. Alternately, specific applications which call for a fully insolubized polymer in particulate form, e.g., as an ion exchange resin, may employ use of multi-functional monomers at higher levels.

The process of the present invention is especially useful in the manufacture of "Hot Can Shoddy". Fiber pad shoddy is a nonwoven product produced from a ground mixture of various scrap fibers. In this process, the ground fibers are formed into a pad which may be subsequently needled and an emulsion polymer is applied onto the surface of a fiber pad and then dried/- cured by direct contact with a hot metal drum, typically held at 300° to 600° F. In this technique, relatively dense shoddy pads are manufactured by needling and the needled fabric is then further bonded with aqueous emulsion. The emulsion is generally coated onto the surface to impregnate the substrate, often as a froth, but is also applied by spray or liquid dip saturation. It is usually desirable for the emulsion polymer to impart rigidity and surface integrity to the pad. To do so, there is usually an attempt to localize the polymer on the surface of the pad. Prior polyvinyl acetate systems build up on the drum surface eventually picking fibers from the pad and requiring the process to be stopped for maintenance.

The process is also useful in the manufacture of textiles where the wet latex on the textile structure is dried by contact with a calendar stack (a series of hot can rolls), which are generally lower temperature than used in the "hot can shoddy", but also tend to build up with polyvinyl acetate systems.

Similarly, the process may be used in the manufacture of textile, fiberfill and other nonwovens made by transporting the wet latex containing fabric through a drying oven while the structure is held or supported on a hot metal carrier grid or belt.

DETAILED DESCRIPTION OF THE PREFERRED EMBODIMENTS

The multi-functional comonomers useful herein are polyethylenically unsaturated comonomers and include lower alkenyl ($C_1$ to $C_4$) lower alkenoates, for example, vinyl crotonate, allyl acrylate, allyl methacrylate; di-lower alkenyl ($C_1$ to $C_4$) alkanedioates, for example, divinyl adipate, diallyl adipate; di-lower alkenyl ($C_1$ to $C_4$) benzenedicarboxylates, for example, diallyl phthalate; lower alkanediol ($C_1$ to $C_4$) di- or tri-lower alkenoates, for example, ethylene glycol diacrylate, ethylene glycol dimethacrylate, butanediol diacrylate, butanediol dimethacrylate; lower ($C_1$ to $C_4$) alkylene bisacrylamides and lower alkylene ($C_1$ to $C_4$) bis-methacrylamides, for example, methylene bis-acrylamide; triallyl cyanurate; etc. Preferable multi-functional comonomers are triallyl cyanurate are diallyl maleate. They are added to the emulsion polymers at a level of 0.5 to 5% (dry weight), preferably 1.0 to 1.5%.

The major portion of the emulsion polymer comprises a vinyl ($C_1$–$C_2$) ester, preferably vinyl acetate, which may optionally be copolymerized with up to about 20%, by dry weight, of a mono-ethylenically unsaturated copolymerizable comonomers such as (meth)acrylates, maleates, (meth)acrylic acid, ethylene, vinyl chloride and vinyl versatate as well as other copolymerizable comonomers.

The choice of the particular polymer backbone is determined by the specific application needs and economics, with higher levels of vinyl acetate desirable for the stiff binders used for shoddy-pad and fiberfill and lower levels of vinyl acetate (as little as 80%) used in the manufacture of softer non-wovens.

Although not required, the polymer emulsion may also contain minor amounts (e.g. 0.5 to 6%, preferably 1 to 3%) of post-crosslinking comonomers. Suitable post-crosslinking (i.e. latent) comonomers include: N-alkylolamides of alpha, beta ethylenically unsaturated carboxylic acids having 3–10 carbons, such as N-methylol acrylamide, N-ethanol acrylamide, N-propanol acrylamide, N-methylol methacrylamide, N-ethanol methacrylamide, N-methylol maleamic acid, N-methylol acid esters; the N-alkylol amides of the vinyl aromatic acids, such as N-methylol-p-vinylbenzamide and the like; also N-(alkoxymethyl) acrylates and methacrylates, where the alkyl group has from 1-8 carbon atoms, such as N-(methoxymethyl) acrylamide, N-(butoxymethyl) acrylamide, N-(methoxymethyl) methacrylamide, N-(butoxymethyl) allyl carbamate and N-(methoxymethyl) allyl carbamate, and mixtures of these monomers with allyl carbamate, acrylamide or methacrylamide. The latent crosslinking agent provides thermosetting characteristics to the polymer emulsion. Upon the subsequent application of energy the latent crosslinking agent forms an insoluble crosslinking network, with the crosslinking being triggered generally by heat, radiation or chemical reaction after the polymer emulsion has been formed and applied.

Olefinically unsaturated acids may also be employed in the polymerization. These acids include the alkenoic acids having from 3 to 6 carbon atoms, such as acrylic acid, methacrylic acid, crotonic acid; alkenedioic acids, e.g., itaconic acid, maleic acid or fumaric acid or mixtures thereof.

In addition, certain copolymerizable monomers which assist in the stability of the copolymer emulsion, e.g., vinyl sulfonic acid and 2-acrylamido-2-methylpropane sulfonic acid are used herein as latex stabilizers. These stabilizers are added in amount of from about 0.2 to 3% by weight of the monomer mixture.

Conventional batch, semi-batch or continuous emulsion polymerization procedures may be utilized herein. Generally, the monomers are polymerized in an aqueous medium under pressures not exceeding 100 atomspheres in the presence of a catalyst and at least one emulsifying agent.

Suitable as polymerization catalysts are the water-soluble free-radical-formers generally used in emulsion polymerization, such as hydrogen peroxide, sodium persulfate, potassium persulfate and ammonium persulfate, as well as tert-butyl hydroperoxide, in amounts of between 0.01 and 3% by weight, preferably 0.01 and 1% by weight based on the total amount of the emulsion. They can be used alone or together with reducing agents such as sodium formaldehyde-sulfoxylate, ferrous salts, sodium dithionite, sodium hydrogen sulfite, sodium sulfite, sodium thiosulfate, as redox catalysts in amounts of 0.01 to 3% by weight, preferably 0.01 to 1% by weight, based on the total amount of the emulsion.

The free-radical-formers can be charged in the aqueous emulsifier solution or be added during the polymerization in doses.

The polymerization is carried out at a pH of between 2 and 7, preferably between 3 and 5. In order to maintain the pH range, it may be useful to work in the presence of customary buffer systems, for example, in the presence of alkali metal acetates, alkali metal carbonates, alkali metal phosphates. Polymerization regulators, like mercaptans, aldehydes, chloroform, ethylene chloride and trichloroethylene, can also be added in some cases.

The emulsifying agents are those generally used in emulsion polymerization, as well as optionally present protective colloids. It is also possible to use emulsifiers alone or in mixture with protective colloids.

The emulsifiers can be anionic, cationic, nonionic surface-active compounds or mixtures thereof. Suitable anionic emulsifiers are, for example, alkyl sulfonates, alkylaryl sulfonates, alkyl sulfates, sulfates of hydroxyalkanols, alkyl and alkylaryl disulfonates, sulfonated fatty acids, sulfates and phosphates of polyethyoxylated alkanols and alkylphenols, as well as esters of sulfosuccinic acid. Suitable cationic emulsifiers are, for example, alkyl quaternary ammonium salts, and alkyl quaternary phosphonium salts. Examples of suitable non-ionic emulsifiers are the addition products of 5 to 50 mols of ethylene oxide adducted to straight-chained and branch-chained alkanols with 6 to 22 carbon atoms, or alkylphenols, or higher fatty acids, or higher fatty acid amides, or primary and secondary higher alkyl amines; as well as block copolymers of propylene oxide with ethylene oxide and mixtures thereof. When combinations of emulsifying agents are used, it is advantageous to use a relatively hydrophobic emulsifying agent in combination with a relatively hydrophillic agent. The amount of emulsifying agent is generally from about 1 to about 10, preferably about 2 to about 8, weight percent of the monomers used in the polymerization.

The emulsifier used in the polymerization can also be added, in its entirety, to the initial charge to the polymerization zone or a portion of the emulsifier, e.g. from 90 to 25 percent thereof, can be added continuously or intermittently during polymerization.

Various protective colloids may also be used in place of, or in addition to, the emulsifiers described above. Suitable colloids include partially acetylated polyvinyl alcohol, e.g., up to 50 percent acetylated, casein, hydroxyethyl starch, carboxymethyl cellulose, gum arabic, and the like, as known in the art of synthetic emulsion polymer technology. In general, these colloids are used at levels of 0.05% to 4% by weight based on the total emulsion.

The polymerization reaction is generally continued until the residual vinyl acetate, monomer content is below 1%. The completed reaction product is then allowed to cool to about room temperature, while sealed from the atmosphere.

The emulsion binders disclosed herein can be applied by spray, roll coating, foam/froth coating, saturation or any other method, all these methods result in a fabric structure with wet latex on the fabric surface which can be prone to adherence to a hot metal surface during drying.

The fibers to be treated with the emulsion and subsequently contacted with the hot melt surface include a wide variety of natural or synthetic fibers including, for example, cotton, kapok, wool, rayon, polyester, nylon, polypropylene, acetate, triacetate, wood pulp, jute, sisal, glass, mineral wool, and the like. Other additives, conventionally used in the production of the particular textiles, may also be incorporated therein.

EXPERIMENTAL

Several experimental emulsions were prepared and evaluated as possible binders for fiber pads produced by the hot can shoddy procedure.

A typical emulsion was prepared using a redox initiation system as follows: A 12 liter stainless steel kettle equipped with heating/cooling means, variable rate stirrer and means of metering monomers and initiators was employed. To a 12 liter stainless steel kettle containing baffles was charged 6 g (of a 35% w/w solution in water) alkyl aryl polyethylene oxide (30 moles ethylene oxide), 4 g (of a 1% solution in water) ferrous sulfate solution and 4 g sodium formaldehyde sulfoxylate in 3120 g water. After purging with nitrogen, 400 g vinyl acetate was charged to the reactor. The contents were then heated to about 50° and the polymerization was initiated by simultaneously metering in solutions of 12 g sodium persulfate in 160 g water and 4 g sodium formaldehyde sulfoxylate in 160 g water. The initiators were added at a uniform rate over a period of 5½ hours. As the vinyl acetate converted to polymer, the internal temperature was raised to 62° C. and held there for 10 minutes. After seed conversion (10 minute hold at 62° C.), polymerization continued via an addition, of a pre-emulsified blend of 3200 g vinyl acetate, 400 g butyl acrylate and 40 g diallyl maleate in a solution of 120 g (of a 35% w/w solution in water) disodium sulfosuccinate, 80 g (of a 70% w/w solution in water) alkyl aryl polyethylene oxide (30 moles ethylene oxide), 280 g (of a 48% w/w solution in water) N-methylol acrylamide and 840 g water. The pre-emulsified monomer blend was added at a uniform rate over a period of 4½ hours. The internal temperature was maintained at about 62° C. until the polymerization was finished. At the end of the intitator slow additions, 0.5 g tertiary butyl hydroperoxide in 20 g water was added uniformly over 5 minutes and held for 15 minutes. After the 15 minute hold, 1 g sodium formaldehyde sulfoxylate in 40 g water was added uniformly over 30 minutes and then held for 30 minutes. During the 30 minute hold, 8 g preservative was added uniformly over 15 minutes. After this procedure the internal temperature was cooled to 25°-30° C. and the product discharged.

The resulting polymeric emulsion was then tested for hot adhesion to metal using the following peel test:

PEEL TEST adjust solids to 20%
preheat stainless steel plate to 400° F.
saturate Kraft paper on preheated plate
roll in place with six passes of a rubber roller
allow paper to remain in place for 120 sec.
pull off of plate with hand held scale
record maximum pounds of force on scale.

The composition described above gave a peel test value of 0 lbs., and released easily from the hot metal drier.

Using similar procedures, but varying the comonomers the emulsions disclosed in Table I were prepared and tested. The results of the testing are also shown in Table I.

TABLE I

| Emulsion | VA | BA | VV-10 | NMA | TAC | Peel Test (lbs.) |
|---|---|---|---|---|---|---|
| 1 | 100 | — | — | — | 0.50 | 2.00 |
| 2 | 100 | — | — | — | 0.50 | 2.25 |
| 3 | 100 | — | — | — | 0.75 | 2.50 |
| 4 | 100 | — | — | — | 1.00 | 1.75 |
| 5 | 100 | — | — | — | 1.25 | 1.75 |
| 6 | 90 | 10 | — | 3.5 | 0.50 | 2.00 |
| 7 | 95 | 5 | — | 3.5 | 0.50 | 1.50 |
| 8 | 90 | 10 | — | 3.5 | 0.50 | 1.50 |
| 9 | 85 | 15 | — | 3.5 | 1.00 | 0.00 |
| 10 | 95 | — | 5 | 2.5 | 0.75 | 1.50 |
| 11 | 95 | — | 5 | 2.5 | 1.00 | 1.00 |
| 12 | 95 | — | 5 | 2.5 | 1.25 | 0.00 |
| 13 | 100 | — | — | 2.5 | 0.50 | 0.40 |
| 14 | 100 | — | — | 2.5 | 0.75 | 0.00 |
| 15 | 100 | — | — | 2.5 | 1.00 | 1.00 |
| 16 | 85 | 15 | — | 3.5 | 1.00 | 0.00 |
| 17 | 85 | 15 | — | 3.5 | 1.25 | 0.00 |
| 18 | 95 | — | 5 | 2.5 | 1.00 | 0.00 |
| 19 | 95 | — | 5 | 2.5 | 1.25 | 0.00 |
| 20 | 85 | 15 | — | 3.5 | 1.00 | 0.00 |
| 21 | 95 | — | 5 | 2.5 | 1.00 | 0.00 |
| Control 1 | | | | | | 1.00 |

TABLE I-continued

| Emulsion | VA | BA | VV-10 | NMA | TAC | Peel Test (lbs.) |
|---|---|---|---|---|---|---|
| Control 2 | | | | | | 3.00 |

Key:
VA = vinyl acetate
BA = butyl acrylate
VV-10 = vinyl versatate
NMA = N-methylol acrylamide
TAC = triallyl cyanurate
Control 1 = (acrylic-NMA copolymer)
Control 2 = (vinylacetate-NMA copolymer)

In the results of the peel test presented in Table I, the lower the value the greater is the non-stick behavior of the polymer latex toward the hot metal surface. Thus, the controls require relatively higher levels of force to remove the kraft paper from the heated metal plate. In contrast, the binders of the current invention released easily from the hot melt drier surface with the polymers containing the higher levels of multi-functional monomer showing no measurable adherance to the metal surface. Moreover, the resultant emulsion polymers exhibited improved heat resistance properties when tested using conventional mechanical testing techniques.

EXAMPLE II

A similar emulsion copolymer was prepared using thermal initiation as follows: A 12 liter stainless steel kettle equipped with heating/cooling means, variable rate stirrer and means of metering monomers and initiators was employed. To a 12 liter stainless steel kettle containing baffles was charged 120 g (of a 20% w/w solution in water) sodium alkyl aryl polyethylene oxide sulfate (3 moles ethylene oxide), 8 g (of a 70% w/w solution in water) alkyl aryl polyethylene oxide (40 moles ethylene oxide), 1.6 g sodium acetate and 10 g sodium sulfate in 2900, water. After purging with nitrogen, 400 g vinyl acetate was charged to the reactor. The contents were then heated to 59° to 61° C. and 6 g sodium persulfate in 100 g water was charged to the reactor. Heating continued to achieve an internal contents temperature of 66° to 68° C. As the vinyl acetate converted to polymer, the internal temperature was raised to 78° to 80° C. and held for 10 minutes. After seed coversion (10 minute hold at 78° to 80° C.), polymerization continued via simultaneous additions of a pre-emulsified blend of 3200 g vinyl acetate, 400 g butyl acrylate and 40 g diallyl maleate in a solution of 130 g (of a 31% w/w solution in water) disodium ethoxylated alcohol half ester of sulfosuccinate acid, 80 g (of a 70% w/w solution in water) alkyl aryl polyethylene oxide (30 moles ethylene oxide), 200 g (of a 48% w/w solution in water) N-methylol acrylamide and 8 g sodium acetate in 840 g water concurrent with a catalyst solution consisting of 22 g sodium persulfate in 600 g water. The pre-emulsified monomer blend and catalyst solution was added with uniform rates 5½ and 6 hours, respectively. The internal temperature was maintained at 78° to 80° C. until 30 minutes after the end of the catalyst solution addition. At this point the internal temperature was lowered to 60°-65° C. where upon 0.5 g tertiary butylhydroperoxide in 20 g water was added uniformly over 5 minutes and held for 15 minutes. After the 15 minute hold, 5 g sodium formaldehyde sulfoxylate in 200 g water was added uniformly over 30 minutes and then held for 30 minutes. During the 30 minute hold, 8 g preservative was added uniformly over 15 minutes.

After this procedure the internal temperature was cooled to 25°-30° C. and the product discharged.

When tested, the emulsion gave a 0 value in the peel test while a comparative NMA-containing vinyl acetate composition had a 3.5 pound value.

Using a similar procedure, an emulsion was prepared from 100 parts vinyl acetate, 3.36 parts N-methlol acrylamide and 1.0 parts diallyl maleate. When tested as a shoddy binder, the emulsion gave a 0 lbs. peel value.

What is claimed is:

1. A process for treating textile substrates comprising the steps of 1) impregnating the substrate with an emulsion polymer comprising:
   a) 80-99.5% by weight of a vinyl ester;
   b) 0-20% by weight of a mono-ethylenically unsaturated copolymerizable comonomer;
   c) 0.5 to 5% by weight of a polyethylenically unsaturated comonomer;
   d) 0 to 6% by weight of a post-crosslinking comonomer; and
2) drying the coated substrate by contact with a heated metal surface.

2. The process of claim 1 wherein the polyethylenically unsaturated comonomer is selected from the group consisting of lower alkenyl lower alkenoates, di-lower alkenyl alkanedioates, di- or tri-lower alkenyl benzenedicarboxylates, lower alkanediol di- or tri-lower alkenoates, lower alkylene bisacrylamides and lower alkylene bis-methacrylamides.

3. The process of claim 2 wherein the polyethylenically unsaturated comonomer is triallyl cyanurate or diallyl maleate.

4. The process of claim 1 wherein the polyethylenically unsaturated comonomer is added in an amount of 1.0 to 1.5% by weight.

5. The process of claim 1 wherein the vinyl ester is vinyl acetate.

6. The process of claim 1 wherein the mono-ethylenically unsaturated copolymerizable comonomer is selected from the group consisting of (meth)acrylates, maleates, (meth)acrylic acid, ethylene, vinyl chloride and vinyl versatate.

7. The process of claim 1 wherein the post-crosslinking comonomer is an N-alkylolamide of an alpha beta ethylenically unsaturated carboxylic acid having 3 to 10 carbon atoms.

8. The process of claim 7 wherein the post-crosslinking comonomer is N-methylol acrylamide.

9. In a process for treating textile substrates with a vinyl ester based emulsion polymer containing 80-99.5% by weight vinyl ester and subsequently drying the substrate by contact with a heated metal roll, the improvement which comprises interpolymerizing 0.5 to 5% by weight of a polyethylenically unsaturated crosslinking comonomer into the vinyl ester emulsion prior to treating said substrates.

* * * * *